United States Patent [19]

Diem et al.

[11] 4,153,410

[45] May 8, 1979

[54] PRODUCTION OF SULFUR-FREE COMBUSTION GASES OF LOW SOOT CONTENT

[75] Inventors: Hans Diem, Ludwigshafen; Albrecht Aicher, Frankenthal; Hans Haas; Christian Dudeck, both of Ludwigshafen; Fritz Finkbeiner, Altrip, all of Fed. Rep. of Germany

[73] Assignee: BASF Aktiengesellschaft, Fed. Rep. of Germany

[21] Appl. No.: 851,695

[22] Filed: Nov. 15, 1977

[30] Foreign Application Priority Data

Dec. 7, 1976 [DE] Fed. Rep. of Germany ..... 2655321

[51] Int. Cl.[2] ..... F23D 13/20

[52] U.S. Cl. ..... 431/5; 431/2; 431/8

[58] Field of Search ..... 431/2, 3, 5, 6, 8, 202; 23/277 C

[56] References Cited

U.S. PATENT DOCUMENTS

| | | | |
|---|---|---|---|
| 3,907,488 | 9/1975 | Takahashi et al. | 431/2 |
| 3,917,796 | 11/1975 | Ebeling | 431/5 X |
| 3,985,494 | 10/1976 | Childree | 431/5 |

*Primary Examiner*—Edward G. Favors

*Attorney, Agent, or Firm*—Keil & Witherspoon

[57] ABSTRACT

Sulfur-free combustion gases of low soot content are produced by mixing oxygen and an off-gas of a defined composition in a defined weight ratio, passing the final mixture thus obtained through a defined number of slit channels of gas burners into a combustion chamber and combusting it at a defined temperature. Compared to the prior art, the process of the invention gives sulfur-free combustion gases, containing little or no soot (in general containing no detectable soot), more simply and more economically. These gases are used for heating, in particular for raising steam.

14 Claims, No Drawings

PRODUCTION OF SULFUR-FREE COMBUSTION GASES OF LOW SOOT CONTENT

The present invention relates to a process for the production of sulfur-free combustion gases of low soot content by passing a starting gas mixture of a defined composition and air in a defined ratio through a defined number of slit-shaped channels of one or more gas burners into a combustion chamber and burning the resulting mixture at a defined temperature.

Ullmanns Encyklopadie der technischen Chemie, volume 4, pages 649 et seq. discloses that combustible gases in the form of mixtures of air and gaseous or liquid hydrocarbons, eg. methane, benzene or gasoline, may be burned and the resulting combustion gases used as heating gases. These combustion gases virtually always contain a certain proportion of soot; in particular, soot forms on incomplete combustion of the hydrocarbons (Ullmann, loc. cit., volume 14, pages 793 and 794; Hoffmann, Anorganische Chemie (Vieweg, Braunschweig, 16th edition), page 330). Soot is finely divided carbon which may still contain some oxygen, hydrogen and, to a lesser degree, sulfur, nitrogen and other concomitant materials. The deposition of soot interferes with the heating effect and hence an excess of air is used so that the carbon in the hydrocarbon starting materials is as far as possible combusted simultaneously with the hydrogen (Ullmann, loc. cit., volume 4, page 709). In combustion gases containing soot, the content of the latter may, depending on the completeness of combustion, be up to 10 percent by weight, based on the amount by weight of the hydrocarbon used. In addition to reducing the heating effect, the deposition of soot entails other operating difficulties, for example increased cost of cleaning the installations and pipe connections, blockage of valves or pipe constrictions, resulting in breakdowns, interference with chemical reactions by the presence of soot, or a reduction in activity, or poisoning, of catalysts.

Processing, December 1974, p. 13, discloses that tail gases from the manufacture of formaldehyde, composed of 75 percent by volume of $N_2$, 20 percent by volume of $H_2$ and 5 percent by volume of $CO+CO_2$, with a lower calorific value LCV=60 Btu/ft$^3$ (about 128 kilojoule/m$^3$ (S.T.P.)) may still be employed as fuel and that the heat released from the burnt tail gases may be used for raising steam and hence for operating the formaldehyde production. The LCV of the tail gases is expressly stated to be very low to allow burning the gases with a stable flame in a special combustion chamber. Only very small amounts of formaldehyde and methanol may be present in the tail gases. If the process is carried out on an industrial scale, the stated 5 per cent by volume of oxides of carbon prove to comprise about 4.3 percent by volume of carbon dioxide and 0.7 percent by volume of carbon monoxide (Dubbels Taschenbuch fur den Maschinenbau, 12th edition (1966), Springer-Verlag Berlin, page 468).

We have found that sulfur-free combustion gases of low soot content, which comprise from 4.94 to 5.62 percent by weight of carbon dioxide, from 10.98 to 13.5 percent by weight of water vapor, from 79.53 to 82.76 percent by weight of nitrogen, from 0.93 to 1.03 percent by weight of noble gases and from 0.29 to 0.42 percent by weight of oxygen, may be produced advantageously by feeding a gas mixture, which comprises from 81.3 to 85 percent by weight of nitrogen, from 6.4 to 7.5 percent by weight of carbon dioxide, from 0.2 to 0.9 percent by weight of carbon monoxide, from 5.9 to 7 percent by weight of water vapor, from 1 to 1.6 percent by weight of hydrogen, from 0.02 to 0.1 percent by weight of formaldehyde, from 0.01 to 0.2 percent by weight of methanol and from 1.4 to 1.47 percent by weight of noble gases, at a flow velocity of from 5.5 to 18 meters per second, and air at a flow velocity of from 7.5 to 20 meters per second, through the slit-shaped channels of gas burners into a combustion chamber, mixing the gas mixture and the air with one another before or during entry into the combustion chamber, in a molar ratio of from 0.39 to 1.29 moles of oxygen contained in the air per mole of hydrogen of the gas mixture, and burning the final mixture at an internal temperature of the combustion chamber of from 560° to 1,200° C., from 1 to 10 burners and from 2 to 18 slit channels per burner being used.

Compared to the prior art, the process of the invention provides a simpler and more economical way of producing sulfur-free combustion gases which contain little or no soot, and in general contain no detectable soot. These advantageous results are surprising in view, in particular, of the conditions disclosed in the publication in Processing. Contrary to what is disclosed there, the process according to the invention specifically used off-gas mixtures comprising from 67.1 to 75.1 percent by volume of $N_2$, from 12.2 to 18.3 percent by volume of $H_2$, from 3.6 to 3.9 percent by volume of $CO_2$, from 0.18 to 0.75 percent by volume of CO, from 8.0 to 8.95 percent by volume of water vapor, from 0.01 to 0.13 percent by volume of methanol vapor, from 0.01 to 0.07 percent by volume of formaldehyde gas and from 0.8 to 0.9 percent by volume of noble gases, and has a lower calorific value $H_u$ of from 76.2 to 117.8 kilojoule/cubic meter (S.T.P.), the last-mentioned unit being as defined in Ullmanns Encyklopadie der technischen Chemie, volume 4, page 657; $H_u$ is the lower calorific value of combustible gases as defined in Ullmann (loc. cit.), page 658. The content of hydrogen and carbon dioxide, according to the invention, is substantially lower and on the other hand the content of water vapor in the gas mixture is high. In view of these differences in the composition of the gas mixture and the much lower calorific value of the starting gas mixture according to the invention, it would have been expected, from the data in Processing, that uniform combustion of the mixture with a stable flame and without significant formation of soot would not be possible. It would also have been expected that the mixtures according to the invention would not ignite, or would ignite irregularly, and the water vapor contained in the mixture would condense entirely or partially in the combustion chamber and cause corrosion.

It is an advantage of the process according to the invention that gas mixtures with comparatively low calorific values are used as fuel gases; such mixtures are specifically obtained in the industrial manufacture of formaldehyde. Accordingly, even off-gases of the composition according to the invention, containing water vapor, can be ignited without using high ignition temperatures and can be burned continuously, with a stable flame. The final gas mixture according to the invention (ie. that combustion gases) advantageously serves as a heating gas, especially for generating steam. The combustion temperatures can be lowered, when using the starting gas mixtures (combustible gases) according to the invention, as compared to the method described in Processing, and the output of the steam generators operated with the resulting combustion gases can be increased. Lowering the combustion temperature reduces the formation of nitrogen oxides during combustion. This advantage is encountered to an even greater degree when fossil fuels, eg. petroleum or coal, are entirely or partially replaced, as the source of energy, by the heating gases according to the invention; in addition to the reduced formation of nitrogen oxides, the process according to the invention has the further advantage that no sulfur dioxide is formed. For example, in industrial operation fuel oil, when burned, evolves from 20 to 30 kilograms of sulfur dioxide per tonne. The process according to the invention hence dispenses with more extensive off-gas purificaton and monitoring, reduces the content of carbon monoxide, formaldehyde, nitrogen oxides and sulfur dioxide in the air and hence causes less pollution of the environment. It also allows the total installation for the manufacture of formaldehyde to be operated more simply, more economically and more reliably.

The combustion gases can also be used advantageously as heating gases in all other cases where deposition of soot or entrained sulfur dioxide or nitrogenoxides would be undesirable, for example for heating oxide catalysts, eg. oxides of iron, molybdenum, cobalt, nickel, tungsten, aluminum, titanium, phosphorus or chromium. The gases may be used advantageously for heating catalysts used in catalytic synthesis processes, for example for heating silver catalysts which catalyze the reaction of methanol with oxygen to give formaldehyde. Such heating gases are of particular interest in industries, or in locations, where other starting materials for the production of combustion gases, eg. benzene or gasoline, or nitrogen used as a heating gas, are not present in sufficient amount or are uneconomical. For some synthesis, for example the above manufacture of formaldehyde, nitrogen used as a heating gas requires special purification. Air cannot be used as a heating gas for syntheses where it could, during the subsequent reaction, form explosive mixtures, for example in reactions with alkanols. Illuminating gas and town gas give heating gases which in addition to carbon black particularly contain sulfur and hence, for example, deactivate or poison numerous catalysts and/or cause corrosion of the plants. If electrical heating is used, local heating in the middle of the catalyst bed, and soot formation, are frequently observed. In all these cases, the process of the invention gives an economically advantageous and safe heating gas, by a simple method.

To obtain the starting gas mixtures for the process according to the invention, any synthesis which gives appropriate formaldehyde-containing off-gases may be used; as a rule the mixtures are obtained from the manufacture of formaldehyde by oxidative dehydrogenation of methanol in the presence of silver catalysts or other metal catalysts, eg. copper catalysts. For details of the manufacture of formaldehyde, reference may be made to Ullmanns Encyklopadie der technischen Chemie, volume 7 (1956), pages 659 et seq. Suitable starting materials for the manufacture of formaldehyde are pure methanol or technical methanol, advantageously contain from 50 to 95 percent by weight, preferably from 58 to 70 percent by weight, of methanol. Crude methanol, which may or may not be purified in accordance with the processes described in German Published Application DAS 1,277,834, German Pat. No. 1,235,881 and German Pat. No. 1,136,318 by removing a lower-boiling fraction or by treatment with oxidizing agents and/or alkalis, may also be used. The pure or crude methanol may be manufactured by a conventional method (Ullmann, loc. cit., volume 12, pages 402 et seq.), especially by a high-pressure process. Recently, methanol has also been manufactured by the low-pressure process, in which carbon monoxide and hydrogen are reacted to give methanol at pressures below 150 atmospheres and at below 300° C. (British Pat. Nos. 1,010,871 and 1,159,035). The vaporization is as a rule carried out in a conventional vaporizer (Ullmann, loc. cit., B.I.O.S. Final Report No. 1,331; F.I.A.T. Final Report No. 999), with the temperature of the vaporizer liquid at the uppermost vaporizer tray being from 68° to 100° C., under atmospheric or superatmospheric pressure, batchwise or, advantageously, continuously. The methanol vapor or methanol-water vapor mixture leaving the vaporizer may or may not be mixed with a recycled portion of off- gas or with inert gas, and is fed to the reaction chamber. Nitrogen is an example of a suitable inert gas for the process. Advantageously, the vapor mixture is mixed simultaneously with the oxidizing agent and with the off-gas and/or inert gas. The oxidizing agent may be pure oxygen or a gas containing free oxygen, especially air. The oxygen and methanol are advantageously employed in a molar ratio of from 0.3 to 0.6, especially from 0.4 to 0.5, mole of oxygen, or of oxygen contained in air, per mole of methanol. The oxidation may be carried out in the presence of from 1 to 2, advantageously from 1 to 1.65, especially from 1.3 to 1.5, moles of off-gas per mole of methanol.

The catalysts used may be any silver catalysts, for example one of those described in German Published Application DAS 1,231,229 and Ullmanns Encyklopadie der technischen Chemie, volume 7, pages 659 et seq. Advantageously, two-layer or multi-layer silver catalysts are used, for example those described in German Published Application DAS 1,294,360, German Laid-Open Applicaton DOS 1,903,197 or German Published Application DAS 2,322,757. For details of the preparation of the catalyst and the reaction with the catalysts, reference may be made to the above publications. In other respects, the oxidation is carried out in the conventional manner, for example by passing a gaseous mixture of methanol vapor, water vapor and air, with or without inert gas and off-gas, in the above amounts, through the silver catalyst at from about 550° to 750° C., especially from 600° to 700° C. The process is generally carried out continuously at pressures of from 0.5 to 2 atmospheres, preferably from 0.8 to 1.8 atmospheres. It is advantageous to rapidly cool the reaction gases leaving the catalyst zone, for example in less than 1/10 second, for example to 350° C. The cooled gas mixture is then advantageously fed to an absorption tower in which the formaldehyde is washed out with water, advantageously in counter-current. A part of the remaining off-gas may be recycled to the reaction circuit. The proportion of the off-gas which is recycled to the reaction is advantageously from 1 to 2 moles per mole of methanol fed to the reaction. This proportion of off-gas may be treated with a basic compound—advantageously in an amount which gives a pH of not less than 10, preferably from 11 to 13.5—and/or with an oxidizing agent, and is then mixed with the other components of the starting mixture for the reaction, after which it is returned to the reaction chamber.

The off-gas from the formaldehyde absorption can be subjected to one or more further absorptions with water, with mixtures of water and formaldehyde, with mixtures of water and urea-formaldehyde condensates and/or with urea solutions, and can then be employed as a combustible gas for the process according to the invention. Mixtures of off-gases from different installations for the manufacture of formaldehyde, or of off-gases from the manufacture of formaldehyde-urea resins, may also be employed as combustible gases. Where necessary, a lack of certain components in the off-gases can be dealt with by admixing these components, for example hydrogen or nitrogen. The starting gas mixture (combustible gas) used for the process according to the invention is a mixture which comprises from 81.3 to 85, preferably from 82.3 to 84, percent by weight of nitrogen, from 6.4 to 7.5, preferably from 6.6 to 7.1, percent by weight of carbon dioxide, from 5.9 to 7, preferably from 6.2 to 6.7, percent by weight of water vapor, from 1 to 1.6, preferably from 1.2 to 1.5, percent by weight of hydrogen, from 0.2 to 0.9, preferably from 0.45 to 0.77, percent by weight of carbon monoxide, from 0.02 to 0.1, preferably from 0.05 to 0.07,. percent by weight of formaldehyde, from 0.01 to 0.2, preferably from 0.05 to 0.15, percent by weight of methanol and from 1.4 to 1.47, preferably from 1.41 to 1.45, percent by weight of noble gases; in addition, from 0.1 to 0.2 percent by weight of decomposition products and/or impurities may be present in the gas mixture. Such concomitant materials may also be introduced through their presence in the starting materials used, ie. methanol, air and water. Depending on its origin and treatment, the water used may contain numerous impurities, for example metal salts, eg. iron chloride, alkaline earth metal compounds due to hardness of the water; alkali metal salts, metals such as zinc or aluminum or copper, for example originating from pipe materials, nitrates, nitrites and phosphates, and organic decomposition products, eg. phenols. Examples of impurities in crude methanol are alkali metal compounds, eg. sodium formate, sodium bicarbonate, sodium carbonate, sodium acetate, sodium sulfide, sodium methylate, potassium hydroxide and sodium hydroxide, formic acid, aldehydes, eg. acrolein, glyoxal, propionaldehyde and acetaldehyde, ketones, eg. acetone and butan-2-one,, glycol, hexane and dimethyl ether, organic or inorganic compounds, eg. formates or sulfides of metals, eg. iron, chromium, copper, aluminum, zinc and magnesium, sulfur compounds, eg. dimethyl sulfide, esters, eg. dimethyl terephthalate, amines, eg. monomethylamine, dimethylamine and trimethylamine, and ammonia. Examples of impurities present in air are hydrogen sulfide, sulfur dioxide, hydrogen chloride, hydrogen fluoride, halogens, volatile halogen compounds, eg. carbon tetrachloride, ammonia, amines, eg.monomethylamine, dimethylamine and trimethylamine, arsenic and antimony compounds, eg. arsenic trioxide and antimony trioxide, acetylene, phosphorus compounds, eg. phosphine, carbon black, iron oxide dust, hydrogen cyanide, carbon monoxide, foreign materials resulting from the anaerobic decomposition of protein waste materials, eg. mercaptans, indole and scatole, nitrogen oxides, lead compounds, eg. lead tetraethyl and lead tetramethyl, organic compounds, eg. 3,4-benzypyrene, fluoranthrene, pyrene and phenanthrene which enter the air from automotive exhaust gases, and their oxidation products, eg. acrolein. In addition, decomposition products from the synthesis of formaldehyde, for example methane, may be present.

The starting gas mixture is as a rule fed to a combustion chamber batchwise or, preferably, continuously, at from 320° to 400° C., preferably from 350° to 390° C., under subatmospheric, atmospheric or superatmospheric pressure, expediently at a pressure of from −1 to +100 , preferably from +20 to +80, mbar. Its flow velocity is from 5.5 to 18, preferably from 7 to 16, meters per second. It is mixed with air which has a flow velocity of from 7.5 to 20, preferably from 9 to 16, meters per second. The flow velocity in the feed lines corresponds to that in the channels of the burners. The air is as a rule fed in at from 320° to 400° C., preferably from 350° to 390° C., under subatmospheric, atmospheric or superatmospheric pressure, preferably at a pressure of from −1 to +100, especially from 20 to 80, mbar, batchwise or, preferably, continuously. Mixing may take place before entering the burner, in the burner itself or, advantageously, when entering the combustion chamber from the burner. The components are mixed in a ratio of from 0.39 to 1.29, preferably from 0.6 to 1.1, moles of oxygen contained in the air per mole of hydrogen in the starting gas mixture. The material is fed to the combustion chamber through the slit-shaped channels of gas burners. In a preferred embodiment of the process according to the invention, the gas mixture and the air are passed separately from one another through one or more channels of the gas burners employed and are only mixed with one another at the mouth of the burner, and at the same time are ignited.

Advantageously, from 2 to 18, preferably from 4 to 13, slit-shaped channels per burner, and from 1 to 10, preferably from 2 to 6, burners per combustion chamber are used. The channels may differ from one another in construction, material and/or size but are preferably identical to one another. The cross-section of each channel may be of any desired shape but is advantageously oval, round or square or, preferably rectangular. The width to length ratio of the slit cross section is advantageously from 0.03 to 0.6, preferably from 0.08 to 0.3. Whilst the cross-sections inside a channel can differ from one another and/or from the channel inlet cross-section or channel outlet cross-section, the channel cross-section advantageously has the same shape and size from the inlet to the outlet. The preferred channels have a length of from 50 to 150, preferably from 70 to 125, centimeters, a cross-sectional area (slit cross-section) of from 250 to 4,500, preferably from 700 to 2,500, square centimeters, and a width of the slit cross-section of from 5 to 30, preferably from 10 to 20, centimeters.

Any arrangement of the burners in the combustion chamber may be used but preferably the burners are fixed to the bottom of the chamber. The entire bottom of the chamber can be constructed as a burner, i.e., can be used as a surface for the entry of the air and the combustible gases into the chamber; in that case, the bottom is advantageously divided into from 2 to 12 slit-shaped channels for the separate feed of gas mixture and air, and advantageously from 40 to 60 percent of the channels are available for the air. It is, however, more advantageous to provide one, or more particularly, a plurality of burners, of which the combustible gas/air entry surface into the chamber only accounts for from 5 to 70, preferably from 15 to 50 percent, of the total bottom surface. The entry surface of each burner into the chamber may be of any desired shape, and is advantageously oval, round, square or, preferably, rectangular. Preferably, from 1 to 10, especially from 2 to 6, burners are provided and are distributed at any desired distances, or equal distances, from one another over the chamber bottom, or are set out in a special geometrical arrangement; for example, the burners can be arranged in a straight line which divides the bottom surface into half, with the distance between successive burners, and the distance of the two outermost burners from the two walls, being identical.

Preferred combustion chambers have a ratio of the height of the chamber to the width of the bottom of from 1 to 3, preferably from 1.5 to 2.5, and a ratio of the height of the chamber to the length of the bottom of from 1.1 to 3.1, preferably from 1.5 to 2.5. Whilst the burners may differ fom one another in construction, material and/or dimensions, they are advantageously identical to one another. It is advantageous to employ exit surfaces (for air and gas mixture together) per burner of from 0.3 to 1.2, preferably from 0.5 to 1, square meters, total exit surfaces (air and gas mixture) of all burners of the combustion chamber of from 0.3 to 12, preferably from 1 to 6, square meters, and chamber heights of from 1.5 to 32, preferably from 3.6 to 24, meters. The channels of a burner advantageously terminate in a mixing device, the exit surface of which is the entry surface of the burner into the chamber. Suitable mixing devices are mixers and, advantageously, nozzles, eg. injector mixers, mixing chambers or mixing zones with injectors, jet mixers, vortex chamber nozzles, eccentric nozzles, bundle nozzles, centrifugal pressure nozzles, slit nozzles, flat jet nozzles, hollow nozzles and spiral nozzles. It is advantageous to use separate channels for the feed of gas mixture and of air, mix these components in the above nozzles and ignite them at the nozzle orifice. The air-gas mixture can be ignited in the conventional manner, for example by electric sparks of from 5,000 to 20,000 volt. The ignition temperature of the final mixture is as a rule from 540° to 600° C. After ignition, a pale blue, virtually non-luminous flame which is soot-free or almost soot-free forms, and the combustion temperature in the chamber assumes a value of from 560° to 1,200° C., preferably from 700° to 900° C. (measured at the end of the flame cone). Advantageously, the flame cone is adjusted, by appropriately regulating the air supply, so that the distance from the apex of the cone to the end of the cone at the burner orifice is from 50 to 270 centimeters. The diameter of the base of the cone, or the maximum diameter of the flame cone, is advantageously from 10 to 100 centimeters. The more additional air is fed in, the smaller is this cone height and the hotter is the flame. The combustion is carried out batchwise or, as a rule, continuously. The pressure in the combustion chamber is advantageously set to from −1 to 30, preferably from 0 to 20, mbar.

The mixture can also be ignited by a pilot burner which heats the burner orifice to a temperature above the ignition temperature of the final mixture. As the combustion proceeds, its continuation is automatically ensured by the high combustion temperature. The high temperature in the combustion chamber can also be generated by conventional combustion devices, employing conventional fuels such as oil or gas, and located at one or more points in the combustion chamber.

The combustion gases thus obtained contain from 10.98 to 13.50, preferably from 11.5 to 12.5, percent by weight of water vapor, from 4.94 to 5.672, preferably from 5.1 to 5.4, percent by weight of carbon dioxide and from 79.53 to 82.76, preferably from 80.5 to 82.0, percent by weight of nitrogen, from 9.93 to 1.03, preferably from 0.95 to 1.0, percent by weight of noble gases and from 0.29 to 0.42, preferably from 0.3 to 0.46, percent by weight of oxygen. The combustion gases advantageously issue under atmospheric or superatmospheric pressure at the end of the combustion chamber which is remote from the burner, and can be used, without further process steps, as heating gases.

In the Example which follows, parts are by weight.

EXAMPLE

Per hour, 53,100 parts of a gas mixture from a formaldehyde synthesis plant (employing crude methanol, a silver catalyst, and absorption in water), which contains 83.47 percent by weight of $N_2$, 1.31 percent by weight of $H_2$, 6.84 percent by weight of $CO_2$, 0.53 percent by weight of CO, 6.21 percent by weight of $H_2O$, 0.14 percent by weight of $CH_3OH$, 0.06 percent by weight of $CH_2O$ and 1.44 percent by weight of noble gases and has a lower calorific value of $H_u$ (LCV) of 99.7 kilojoule/cubic meter (S.T.P.), and 24,957 parts of air are fed continuously but separately from one another into a combustion chamber. At the bottom of the chamber there are 4 burners with 12 slit-shaped channels (6 for the gas mixture and 67 for the air) per burner. The gas mixture is at 380° C. under a pressure of 70 mbar and has a flow velocity of 15 meters per second, and the air is at 380° C. under a pressure of 22 mbar and has a flow velocity of 15 meters per second. The gas mixture and air are introduced separately through their appropriate channels into all the burners and are mixed with one another in the slit nozzles which are places over the channels in the burners; the final mixture then enters through the nozzle orifice (burner mouth) into the interior of the combustion chamber. The ratio in which the components are mixed corresponds to 1.05 moles of oxygen in the air feed per mole of hydrogen in the gas mixture. The burner channels are all identical and are rectangular. The total exit surface of the final mixture at the burners (i.e., the entry surface into the chamber) is 4,200 square centimeters, the bottom surface of the square combustion chamber is 64 square meters and the chamber height is 16 meters. The burners are arranged equidistant from one another in a circle around the center of the chamber bottom, the radius of the circle being 2 meters.

At the start, the final mixture of air and gas mixture is ignited by heating the mouth of the burner; combustion then takes place continuously with a lasting flame because of the high combustion temperature in the chamber. This temperature is 700° C., whilst the pressure in the combustion chamber is 20 mbar.

The final gas mixture (combustion gases) leaves at the top of the chamber. 78,057 parts of a mixture containing 5.19 percent by weight of carbon dioxide, 12.33 percent by weight of water vapor, 81.28 percent by weight of nitrogen, 0.96 percent by weight of noble gases and 0.34 percent by weight of oxygen are obtained. It is used to generate steam.

We claim:

1. A process for the production of sulfur-free combustion gases of low soot content, which contain by weight from 4.94 to 5.62% of carbon dioxide, from 10.98 to 13.5% of water vapor, from 79.53 to 82.76% of nitrogen, from 0.93 to 1.03% of noble gases and from 0.29 to 0.42% of oxygen, wherein a starting gas mixture which contains by weight from 81.3 to 85% of nitrogen, from 6.4 to 7.5% of carbon dioxide, from 0.2 to 0.9% of carbon monoxide, from 5.9 to 7% of water vapor, from 1 to 1.6% of hydrogen, from 0.02 to 0.1% of formaldehyde, from 0.01 to 0.2% of methanol and from 1.4 to 1.47% of noble gases, at a flow velocity of from 5.5. to 18 meters per second, and air at a flow velocity of from 7.5 to 20 meters per second, are fed through slit-shaped channels of at least one gas burner having such channels to a combustion chamber, the starting gas mixture and the air are mixed with one another, before or during entry into the combustion chamber, in a molar ratio of from 0.39 to 1.29 moles of oxygen contained in the air per mole of hydrogen in the gas mixture, and the resulting mixture is burned at an internal temperature of the combustion chamber of from 560° to 1,200° C., from 1 to 10 burners, and from 2 to 18 slit channels per burner, being employed.

2. A process as claimed in claim 1, in which the starting gas mixture used is a formaldehyde-containing off-gas obtained from the manufacture of formaldehyde by oxidative dehydrogenation of methanol in the presence of a silver catalyst or other metal catalyst.

3. A process as claimed in claim 1, in which the starting gas mixture employed is a mixture which contains by weight from 82.3 to 84% of nitrogen, from 6.6 to 7.1% of carbon dioxide, from 6.2 to 6.7% of water vapor, from 1.2 to 1.5% of hydrogen, from 0.45 to 0.77% of carbon monoxide, from 0.05 to 0.07% of formaldehyde, from 0.05 to 0.15% of methanol and from 1.41 to 1.45% of noble gases.

4. A process as claimed in claim 1, in which a starting gas mixture at a temperature of from 320° to 400° C. and a pressure of from −1 to +100 mbar is used.

5. A process as claimed in claim 1, in which a starting gas mixture at a flow velocity of from 7 to 16 meters per second is used.

6. A process as claimed in claim 1, in which air at a flow velocity of from 9 to 16 meters per second is used.

7. A process as claimed in claim 1, in which air at a temperature of from 320° to 400° C. and a pressure of from −1 to +100 mbar is used.

8. A process as claimed in claim 1, in which a ratio of from 0.6 to 1.1 moles of oxygen contained in the air per mole of hydrogen of the starting gas mixture is used.

9. A process as claimed in claim 1, in which the gas mixture and the air are each fed, separately from one another, through one or more channels of the gas burners employed and are only mixed with one another at the burner mouth, and are ignited at the same time.

10. A process as claimed in claim 1, in which from 4 to 13 slit-shaped channels per burner and from 2 to 6 burners are used.

11. A process as claimed in claim 1, in which the ratio of the width to the length of the slit cross-section of each slit-shaped channel is from 0.03 to 0.6, the slit-shaped channels have a length of from 50 to 150 cm and a cross-sectional area (slit cross-section) of from 250 to 4,500 $cm^2$, and the width of the slit cross-section is from 5 to 30 cm.

12. A process as claimed in claim 1, in which a plurality of burners, of which the combined combustible gas-/air entry surface into the chamber is only from 5 to 70% of the total bottom surface, is employed.

13. A process as claimed in claim 1, in which the combustion temperature in the chamber is from 700° to 900° C., measured at the end of the flame cone.

14. A process as claimed in claim 1, in which the pressure in the combustion chamber is from −1 to 30 mbar.

* * * * *